US006234324B1

(12) United States Patent
Getz

(10) Patent No.: US 6,234,324 B1
(45) Date of Patent: May 22, 2001

(54) SHEET HOLDER

(76) Inventor: Neil Getz, 5506 Taft Ave., Oakland, CA (US) 94618

( * ) Notice: Subject to any disclaimer, the term of this patent is extended or adjusted under 35 U.S.C. 154(b) by 0 days.

(21) Appl. No.: 09/262,586

(22) Filed: Mar. 4, 1999

(51) Int. Cl.[7] ..... B42F 7/10
(52) U.S. Cl. ..... 211/50; 206/555
(58) Field of Search ..... 211/50; D19/92; 206/215, 555, 453, 449

(56) References Cited

U.S. PATENT DOCUMENTS

| | | | | |
|---|---|---|---|---|
| D. 147,591 | * | 9/1947 | Kramer | 211/50 |
| D. 246,373 | | 11/1977 | Crandell et al. . | |
| D. 264,352 | | 5/1982 | Goutchat . | |
| 2,100,720 | | 1/1937 | Page . | |
| 2,621,807 | * | 12/1952 | Rendich | 211/50 X |
| 4,492,307 | * | 1/1985 | Hargrave | 211/50 X |
| 4,505,395 | * | 3/1985 | Nathan | 211/50 X |
| 5,005,709 | | 4/1991 | Stokes . | |

* cited by examiner

*Primary Examiner*—Daniel P. Stodola
*Assistant Examiner*—Erica B. Harris
(74) *Attorney, Agent, or Firm*—Knobbe, Martens, Olson & Bear, LLP

(57) ABSTRACT

A sheet holder is comprised of a base with a sheet holding area, a pair of side posts attached to the base on opposite sides of the sheet holding area, a top post attached to the base at a top edge of the sheet holding area, and a bottom post attached to the base at a bottom edge of the sheet holding area. The side posts are positioned one higher than the other. The bottom post is offset to a side of the sheet holding area corresponding to the lower side post, and the top post is offset to a side of the sheet holding area corresponding to the higher side post. The posts secure a stack of sheets between them on the sheet holding area, and prevent the sheets from rotating or sliding in any direction. The sheet holder can be positioned horizontally or vertically. Heads on the side posts prevent the sheets from falling out when the sheet holder is positioned vertically, or from being blown out by wind. In alternative embodiments for vertical mounting only, the top post is eliminated.

14 Claims, 5 Drawing Sheets

SHEET HOLDER

BACKGROUND OF THE INVENTION

1. Field of the Invention

This invention relates generally to paper trays.

2. Prior Art

Various paper trays are known for holding a stack of paper sheets. U.S. Pat. No. 2,100,720 to Page discloses a paper tray with a base plate and four straight walls defining a rectangular paper holding area. The walls are centered about the longitudinal and traverse medial lines of the holding area, and are spaced from each other to form gaps at the comers of the holding area. The gaps extend short of the medial lines. U.S. Pat. No. 5,005,709 to Stokes discloses a tray with a base and four right-angled walls defining a rectangular holding area. The walls are spaced from each other to form gaps which are centered about the longitudinal and transverse medial lines of the 16 holding area. U.S. Pat. No. Des. 264,352 to Goutchat discloses a tray with a base and two right-angled walls defining a rectangular holding area. The walls are at two diagonally opposite corners of the holding area, and are spaced from each other to form gaps at the other two diagonally opposite comers.

With all the aforementioned trays, paper sheets must be placed onto them by being lowered directly from the top. The trays cannot be used in a vertical position because the sheets will fall out. The wide and tall walls prevent a user from resting a hand on the top sheet for writing. The wide walls limit the grasping areas on the sheets to between the narrow gaps, and make removing the sheets inconvenient. The wide walls also require a relatively large amount of material, so that such trays are more expensive to produce than necessary.

U.S. Pat. No. Des. 246,373 to Crandell et al. discloses a paper tray with a rectangular base, a pair of side walls, and a plurality of end walls. One end of the base is completely unobstructed. The top of the side walls are folded inwardly to retain paper sheets when the tray is positioned vertically. The sheets can only be inserted and removed from the unobstructed end of the base, which is inconvenient. The wide walls also require a relatively large amount of material to produce.

OBJECTS OF THE INVENTION

Accordingly, objects of the present sheet holder are:

- to neatly hold a stack of loose sheets;
- to prevent the sheets from unintentionally sliding and rotating;
- to enable individual sheets to be easily inserted;
- to enable individual sheets to be easily removed;
- to enable the top sheet to be conveniently grasped substantially anywhere along its perimeter;
- to enable a hand to comfortably rest on the top sheet for writing; and
- to be assembled with a minimum of materials for economy.

Further objects of the present invention will become apparent from a consideration of the drawings and ensuing description.

BRIEF SUMMARY OF THE INVENTION

A sheet holder is comprised of a base with a sheet holding area, a pair of side posts attached to the base on opposite sides of the sheet holding area, a top post attached to the base at a top edge of the sheet holding area, and a bottom post attached to the base at a bottom edge of the sheet holding area. The side posts are positioned one higher than the other. The bottom post is offset to a side of the sheet holding area corresponding to the lower side post, and the top post is offset to a side of the sheet holding area corresponding to the higher side post. The posts secure a stack of sheets between them on the sheet holding area, and prevent the sheets from rotating or sliding in any direction. The sheet holder can be positioned horizontally or vertically. Heads on the side posts prevent the sheets from falling out when the sheet holder is positioned vertically, or from being blown out by wind. In alternative embodiments for vertical mounting only, the top post is eliminated.

DETAILED DESCRIPTION OF THE INVENTION

Figure 1:
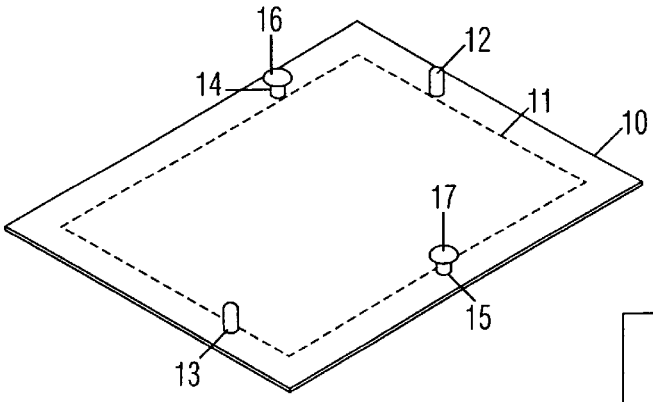
FIG. 1 is a front perspective view of a first embodiment of the present sheet holder.
Figure 2:
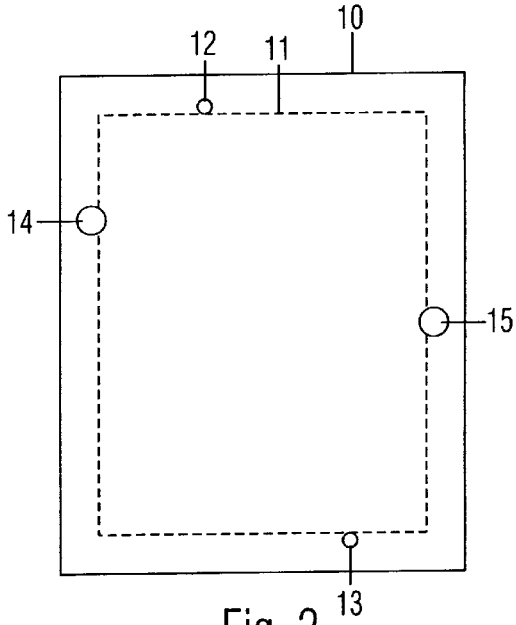
FIG. 2 is a front view of the sheet holder of FIG. 1.
Figure 3:
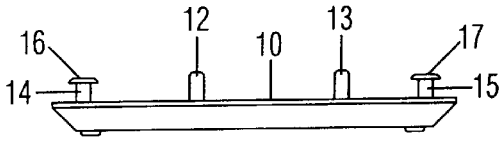
FIG. 3 is an end view of the sheet holder of FIG. 1.

FIGS. 1–3:

A first embodiment of the present sheet holder is shown in FIGS. 1–3. It is comprised of a base 10 with a sheet holding area 11 for holding one or more stacked sheets of any type (not shown). Base 10 preferably has a perimeter parallel to the perimeter of sheet holding area 11 for serving as a visual reference for positioning the sheets, but it may be of other shapes. A top post 12 is attached to base 10 along a top edge of sheet holding area 11. A bottom post 13 is attached to base 10 along a bottom edge of sheet holding area 11, and to the right of top post 12. A higher side post 14 is attached to base 10 along one edge of sheet holding area 11. A lower side post 15 is attached to base 10 along another edge of sheet holding area 11. Lower side post 15 is lower or closer to the bottom edge of sheet holding area than higher side post 14. Side posts 14 and 15 include heads 16 and 17 for securing the sheets and preventing them from falling out when the sheet holder is positioned vertically, e.g., on a wall or held in a hand. Top post 12 and bottom post 13 are preferably headless, and taller than side posts 14 and 15. All posts preferably have curved interior faces for enabling smooth insertion of sheets. All posts are preferably taller than they are wide for minimizing their footprints for user comfort, and minimizing material for economy.

Figure 4:
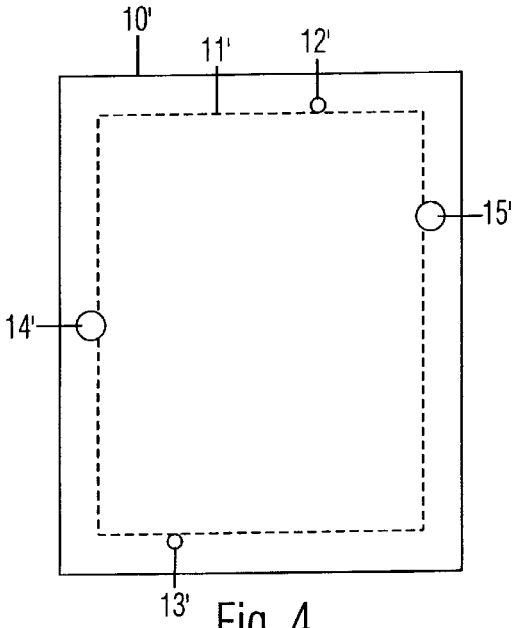
FIG. 4 is a front view of a second embodiment of the present sheet holder.

FIG. 4:

A second embodiment of the present sheet holder shown in FIG. 4 is a mirror image of the first embodiment shown in FIG. 1. A top post 12' is attached to base 10' along a top edge of sheet holding area 11'. A bottom post 13' is attached to base 10' along a bottom edge of sheet holding area 11', and to the left of top post 12'. A lower side post 14' is attached to base 10' along one edge of sheet holding area 11'. A higher side post 15' is attached to base 10' along another side edge of sheet holding area 11', and above lower side post 14'. In both the first and second embodiments, the top post is offset to the side of the sheet holding area corresponding to the higher side post, and the bottom post is offset to the side of the sheet holding area corresponding to the lower side post.

Figure 5:
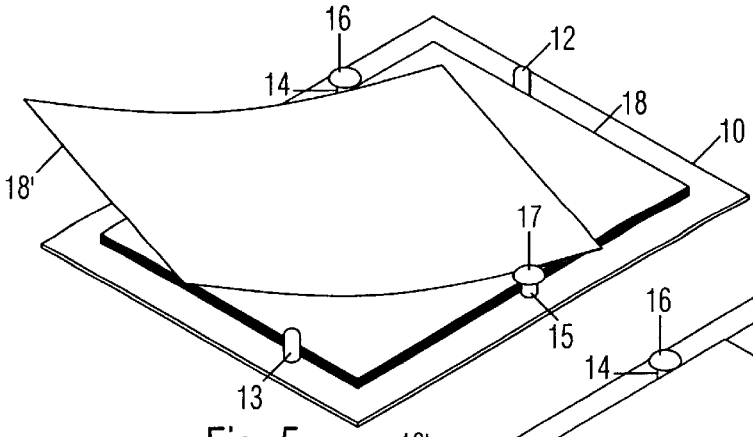
FIG. 5 shows a first step in the insertion of a sheet.
Figure 6:
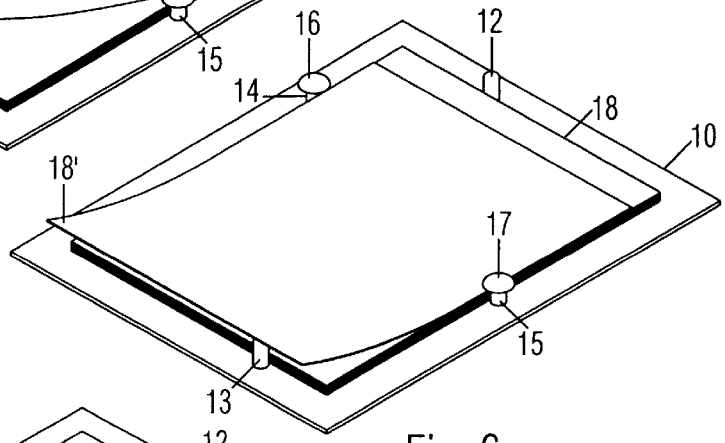
FIG. 6 shows a second step in the insertion of the sheet.
Figure 7:
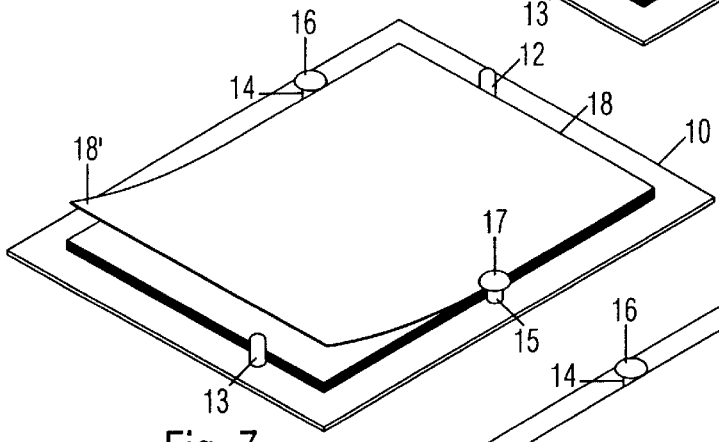
FIG. 7 shows a third step in the insertion of the sheet.
Figure 8:
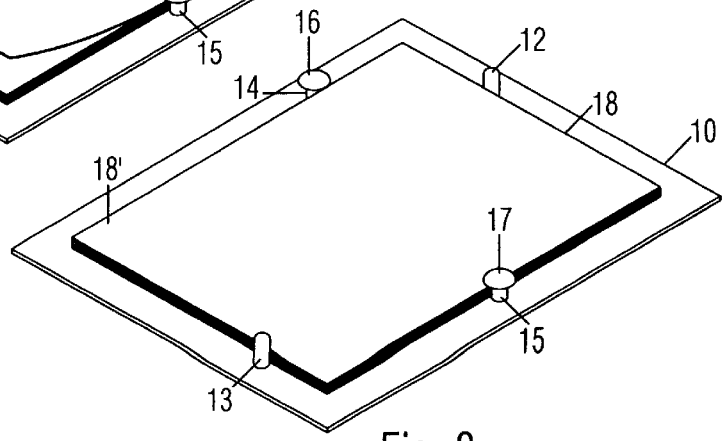
FIG. 8 shows a fourth step in the insertion of the sheet.

FIGS. 5–8:

The sheet insertion process is illustrated in FIGS. 5–8 with the sheet holder of FIG. 1. A stack of sheets 18 is already positioned on the sheet holder. As shown in FIG. 5, an additional sheet 18' to be added is inserted at an angle to the stack, between higher side post 14 and lower side post 15, and to the left of bottom post 13. The bottom of sheet 18' is rotated into alignment with the stack in FIG. 6. The top of sheet 18' is pushed against top post 12 in FIG. 7, and the bottom of sheet 18' is lowered onto the stack in FIG. 8. The insertion process is mirrored for the embodiment shown in FIG. 4.

Since the sheet is inserted into the sheet holding area at an angle, its comers protrude beyond the sheet holding area during the insertion process, as shown in FIG. 5. Therefore, the perimeter of the sheet holding area must be free of any obstruction between the posts to enable the sheet to protrude between the posts, and to avoid interfering with a hand resting on the sheets. Also, no part of the higher side post should be closer to the bottom edge of the sheet holding area than the lower side post, i.e., all of the higher side post is further away from the bottom edge of the sheet holding area than the lower side post. Further, the closest distance between the higher side post and the lower side post must be greater than a width of the sheet holding area.

The arrangement of the posts secure sheets 18 between them and prevent them from rotating or sliding in any direction. The sheets are securely retained even when the sheet holder is positioned vertically, such as when mounted on a wall, or held in a hand like a clipboard. Sheets can be easily inserted or removed. The narrow posts require a minimum of materials to produce. Except for the tiny areas occupied by the posts, the perimeter of the sheets are free of obstructions, so that they can be conveniently grasped almost anywhere along their edges. Further, the small posts do not interfere with a writing hand resting on the top sheet.

Figure 9:
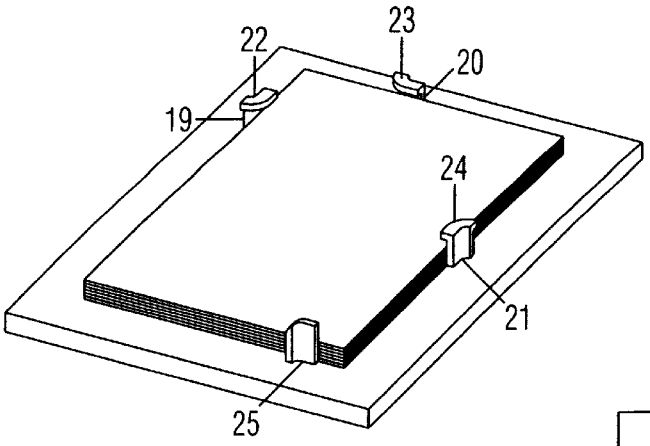
FIG. 9 is a front perspective view of a third embodiment of the present sheet holder.
Figure 10:
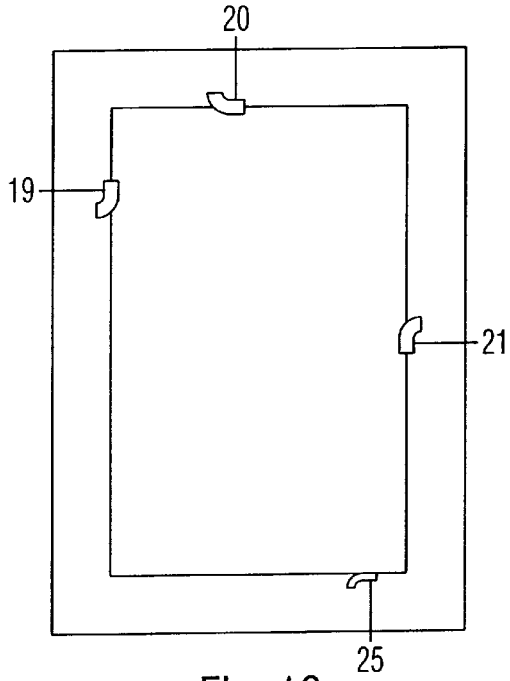
FIG. 10 is a front view of the sheet holder of FIG. 9.
Figure 11:
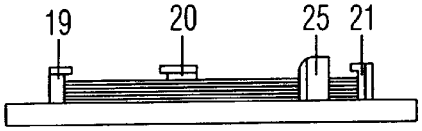
FIG. 11 is an end view of the sheet holder of FIG. 9.

FIGS. 9–11:

A third embodiment of the sheet holder is shown in FIGS. 9–11. It is similar to the first embodiment of FIG. 1, except for the shape of the posts. Higher side post 19, top post 20, and lower side post 21 have heads 22, 23, and 24, respectively. Bottom post 25 is headless. All posts preferably have curved interior faces for enabling smooth insertion of sheets. Posts of other shapes may also be used.

Figure 12:
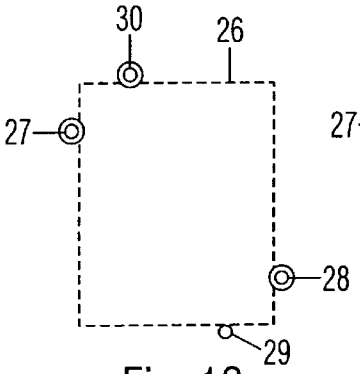
FIG. 12 is a front view of a fourth embodiment of the sheet holder.
Figure 13:
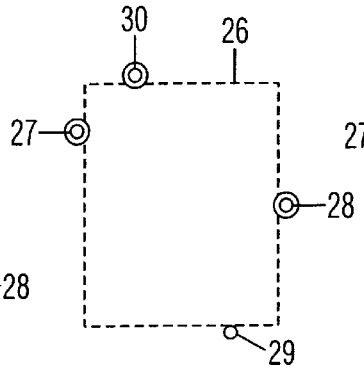
FIG. 13 is a front view of a fifth embodiment of the sheet holder.
Figure 14:
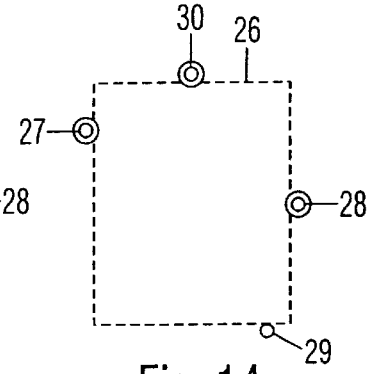
FIG. 14 is a front view of a sixth embodiment of the sheet holder.
Figure 15:
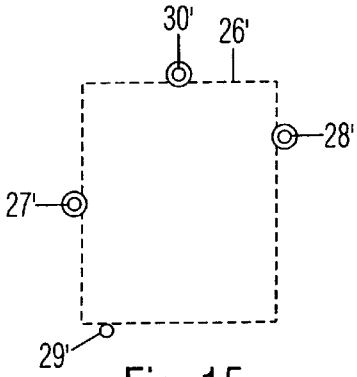
FIG. 15 is a front view of a seventh embodiment of the sheet holder.
Figure 16:
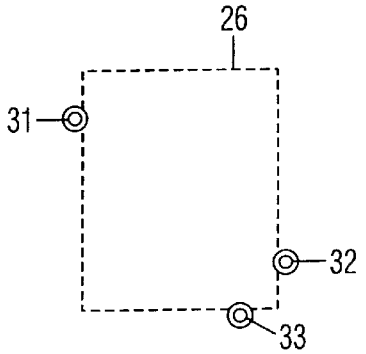
FIG. 16 is a front view of an eighth embodiment of the sheet holder.

FIGS. 12–26:

Additional embodiments of post arrangements are shown in FIGS. 12–26 but without the base for simplicity. In FIGS. 12–14, each arrangement has a sheet holding area 26, a higher side post 27, a lower side post 28, and a bottom post 29 to the right of a top post 30. The arrangement in FIG. 15 is a mirror image of FIG. 14. The arrangement in FIG. 16 includes a higher side post 31, a lower side post 32, and a bottom post 33 which is offset to a side of sheet holding area 26 corresponding to lower side post 32. This arrangement is suitable for vertical mounting, so that the sheets are maintained by gravity against bottom post 33.

Figure 17:
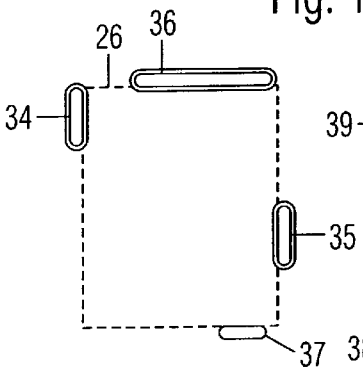
FIG. 17 is a front view of a ninth embodiment of the sheet holder.
Figure 18:
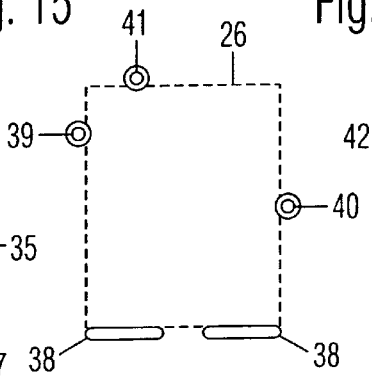
FIG. 18 is a front view of a tenth embodiment of the sheet holder.
Figure 19:
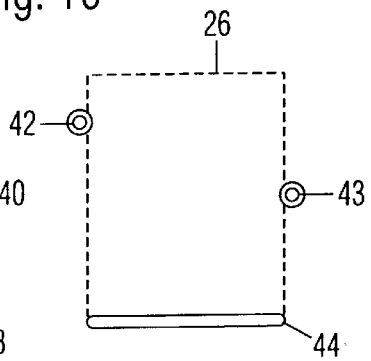
FIG. 19 is a front view of an eleventh embodiment of the sheet holder.

The arrangement in FIG. 17 is similar to that in FIG. 1, except posts 34–37 are wider. The arrangement in FIG. 18 is similar to that in FIG. 1, except a pair of wide bottom posts 38 are used in addition to narrow higher side post 39, lower side post 40, and top post 41. The arrangement in FIG. 19 includes a narrow higher side post 42, a narrow lower side post 43, and a wide bottom post 44, but no top post.

Figure 20:
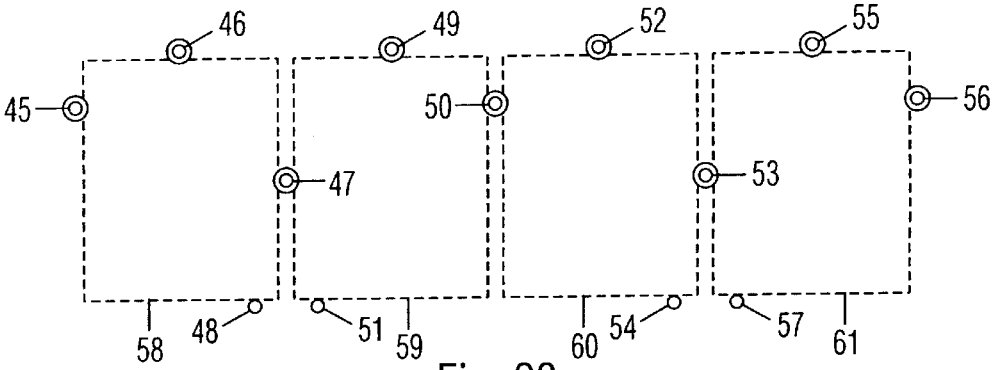
FIG. 20 is a front view of a twelfth embodiment of the sheet holder.
Figure 21:
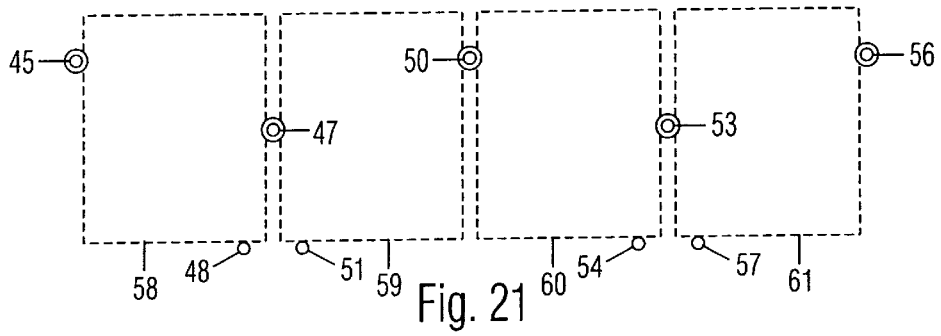
FIG. 21 is a front view of a thirteenth embodiment of the sheet holder.
Figure 22:
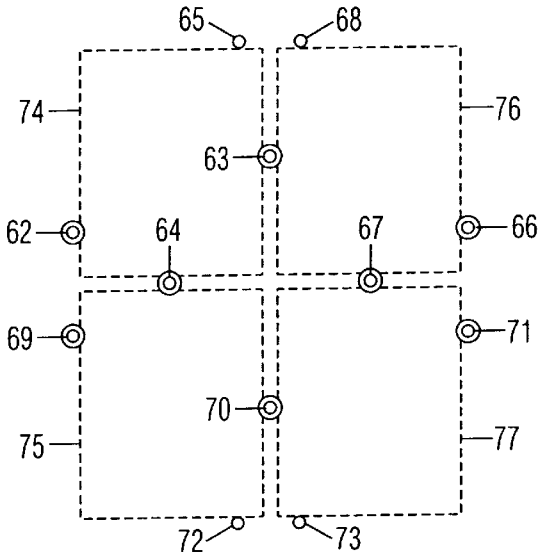
FIG. 22 is a front view of a fourteenth embodiment of the sheet holder.

The arrangement in FIG. 20 includes a plurality of sets of posts 45–57 forming a linear series of sheet holding areas 58–61. Adjacent sheet holding areas share a side post. The bottom post for each sheet holding area is offset to the side corresponding to the lower side post. The arrangement in FIG. 21 is the same as that in FIG. 20 except for the lack of top posts, so that it is suitable for vertical mounting. The arrangement in FIG. 22 has posts 62–73 arranged to form a rectangular array of sheet holding areas 74–77 that share posts between them.

Figure 23:
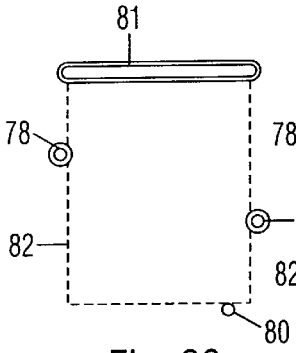
FIG. 23 is a front view of a fifteenth embodiment of the sheet holder.
Figure 24:
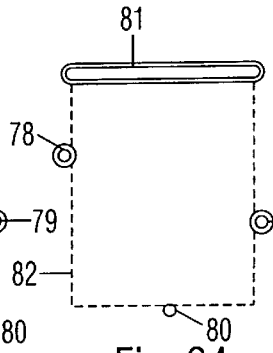
FIG. 24 is a front view of a sixteenth embodiment of the sheet holder.
Figure 25:
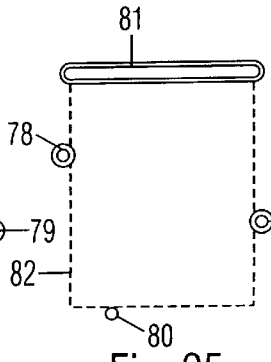
FIG. 25 is a front view of a seventeenth embodiment of the sheet holder.
Figure 26:
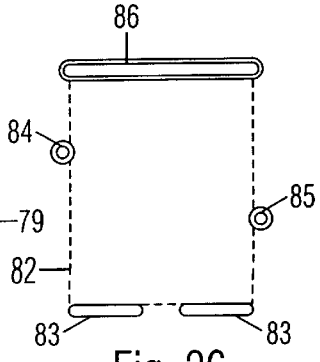
FIG. 26 is a front view of an eighteenth embodiment of the sheet holder.

The arrangements in FIGS. 23–25 each has a narrow higher side post 78, a narrow lower side post 79, and a narrow bottom post 80, but a wide top post 81. Unlike in other arrangements, bottom post 80 in FIG. 24 is centered on the bottom side of sheet holding area 82 because top post 81 is wide enough to prevent the sheets from rotating. The arrangement in FIG. 26 has a pair of wide bottom posts 83, a pair of narrow side posts 84 and 85, and a wide top post 86.

I claim:

1. A sheet holder, comprising:

a base having a sheet holding area with a top edge, a bottom edge, and opposite side edges, said sheet holding area for supporting a stack of sheets;

a higher side post attached to said base along one of said side edges of said sheet holding area for securing said sheets, said higher side post including a head having a lower surface extending outwardly proximate an end of said higher side post distal from the base;

a lower side post attached to said base along another one of said side edges of said sheet holding area for securing said sheets, said lower side post being positioned closer to said bottom edge of said sheet holding area than said higher side post, said lower side post including a head extending outwardly at an end of said lower side post distal from said base; and a bottom post attached to said base along said bottom edge of said sheet holding area for securing said sheets, said bottom post being offset toward one of said side edges of said sheet holding area corresponding to said lower side post, said bottom post being headless and extending farther from the base than said side post heads; wherein:

said higher side post is separated from said bottom post;

a perimeter of said sheet holding area is free of any obstruction between said bottom post and said higher side post;

all of said higher side post is farther away from said bottom edge of said sheet holding area than said lower side post; and a closest distance between said higher side post and said lower side post is greater than a width of said sheet holding area for enabling said sheets to be inserted at an angle.

2. The sheet holder of claim 1, wherein said higher side post, said lower side post, and said bottom post are each greater in height than in width for minimizing a footprint thereof for user comfort and minimizing materials for economy.

3. The sheet holder of claim 1, wherein said higher side post, said lower side post, and said bottom post have curved interior faces for facilitating smooth insertion of said sheets.

4. The sheet holder of claim 1, wherein said bottom post is comprised of a wide post extending between said opposite sides of said sheet holding area.

5. The sheet holder of claim 1, wherein said heads of said higher side post and lower side post can retain said sheets when said sheet holder is positioned with the base vertically oriented.

6. The sheet holder of claim 1, further including a second bottom post offset toward another one of said side edges of said sheet holding area for increasing stability of said sheets.

7. A sheet holder, comprising:

a base having a sheet holding area with a top edge, a bottom edge, and opposite side edges, said sheet holding area for supporting a stack of sheets;

a single higher side post attached to said base along one of said side edges of said sheet holding area for securing said sheets, said higher side post comprising a head at a distal end from said base, said head having a lower surface extending outwardly parallel to said base;

a single lower side post attached to said base along another one of said side edges of said sheet holding area for securing said sheets, said lower side post being positioned closer to said bottom edge of said sheet holding area than said higher side post, said lower side post comprising a head at a distal end from said base, said head having a lower surface extending outwardly parallel to said base; and a single top post attached to said base along said top edge of said sheet holding area for securing said sheets, said top post being headless and extending farther from said base than said lower surface of said higher and lower side post heads; and a bottom post attached to said base along said bottom edge of said sheet holding area for securing said sheets, said bottom post being offset toward one of said side edges of said sheet holding area corresponding to said lower side post, said bottom post being headless and extending farther from the base than said lower surface of said higher and lower side post heads;

for facilitating insertion of said sheets and maximizing user comfort:

said higher side post, said lower side, said top post and said bottom post are separated from each other;

a perimeter of said sheet holding area is free of any obstruction between said bottom post and higher side post, between said top post and said lower side post, and between said higher side post and said top post;

all of said higher side post is farther away from said bottom edge of said sheet holding area than said lower side post; and a closest distance between said higher side post and said lower side post is greater than a width of said sheet holding area for enabling said sheets to be inserted at an angle.

8. The sheet holder of claim 7, wherein said top post is offset toward one of said side edges of said sheet holding area corresponding to said higher side post.

9. The sheet holder of claim 7, wherein said higher side post, said lower side post, said top post, and said bottom post have curved interior faces for facilitating smooth insertion of said sheets.

10. The sheet holder of claim 7, wherein said top post is comprised of a wide post extending between said opposite sides of said sheet holding area for increasing stability of said sheets.

11. The sheet holder of claim 7, wherein said bottom post is comprised of a wide post extending between said opposite sides of said sheet holding area for increasing stability of said sheets.

12. The sheet holder of claim 7, wherein said lower surfaces of said heads of said higher side post and said lower side post can retain said sheets when said sheet holder is is positioned with the base vertically oriented.

13. The sheet holder of claim 7, further including a second bottom post offset toward another one of said side edges of said sheet holding area for increasing stability of said sheets.

14. A sheet holder, comprising:

a base having a sheet holding area with a top edge, a bottom edge, and opposite side edges, said sheet holding area for supporting a stack of sheets;

a single higher side post attached to said base along one of said side edges of said sheet holding area for securing said sheets;

a single lower side post attached to said base along another one of said side edges of said sheet holding area for securing said sheets, said lower side post being positioned closer to said bottom edge of said sheet holding area than said higher side post; and a single top post attached to said base along said top edge of said sheet holding area for securing said sheets; and a single bottom post attached to said base along said bottom edge of said sheet holding area for securing said sheets, said bottom post being offset toward one of said side edges of said sheet holding area corresponding to said lower side post; wherein:

said higher side post, said lower side post, said top post and said bottom post are separated from each other;

said higher side post, said lower side, said top post and said bottom post are each greater in height than in width;

a perimeter of said sheet holding area is free of any obstruction between said bottom post and said higher side post, between said bottom post and said lower side post, between said top post and said lower side post, and between said top post and said higher side post;

all of said higher side post is farther away from said bottom edge of said sheet holding area than said lower side post;

a closest distance between said higher side post and said lower side post is greater than a width of said sheet holding area for enabling said sheets to be inserted at an angle; and said side posts each include heads at distal ends, said top and bottom posts are headless and extend farther from said base than said side posts.

* * * * *